US008882454B2

(12) United States Patent
Chrabascz et al.

(10) Patent No.: US 8,882,454 B2
(45) Date of Patent: Nov. 11, 2014

(54) RAM AIR FAN BEARING HOUSING

(75) Inventors: Eric Chrabascz, Longmeadow, MA (US); Brent J. Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 620 days.

(21) Appl. No.: 13/279,534

(22) Filed: Oct. 24, 2011

(65) Prior Publication Data

US 2013/0101399 A1 Apr. 25, 2013

(51) Int. Cl.

| | |
|---|---|
| ***F01D 25/12*** | (2006.01) |
| ***F04D 29/58*** | (2006.01) |
| ***F03B 11/02*** | (2006.01) |
| ***B64D 33/02*** | (2006.01) |
| ***F04D 29/046*** | (2006.01) |
| ***F04D 29/64*** | (2006.01) |

(52) U.S. Cl.

CPC ..... *F04D 29/046* (2013.01); *F04D 29/644* (2013.01); *Y10S 384/90* (2013.01)

USPC ..... 415/180; 415/175; 415/108; 244/53 B; 384/900

(58) Field of Classification Search

CPC ..... F04D 25/08; F04D 29/046; F04D 29/644; F04D 2220/10; F04D 2220/34; F04D 2220/50; F04D 2240/90; F04D 2240/91; F04D 2260/31

USPC ..... 415/108, 175, 176, 182.1, 180, 196, 415/197, 207; 384/476, 900, 317, 320, 321; 244/118.5, 53 B, 57, 58; 60/39.83

See application file for complete search history.

(56) References Cited

U.S. PATENT DOCUMENTS

| | | | | |
|---|---|---|---|---|
| 1,940,466 | A | 12/1933 | Sneed | |
| 2,223,847 | A * | 12/1940 | Engdahl | 384/476 |
| 2,527,229 | A | 10/1950 | Roubal | |
| 2,752,515 | A | 6/1956 | Baudry et al. | |
| 3,410,029 | A | 11/1968 | Savage | |

(Continued)

FOREIGN PATENT DOCUMENTS

FR 2603079 A1 * 2/1988

OTHER PUBLICATIONS

Colson et al., U.S. Appl. No. 13/279,588, filed Oct. 24, 2011.
Colson et al., U.S. Appl. No. 13/279,529, filed Oct. 24, 2011.

(Continued)

*Primary Examiner* — Ned Landrum
*Assistant Examiner* — Ryan Ellis
(74) *Attorney, Agent, or Firm* — Kinney & Lange, P.A.

(57) ABSTRACT

A ram air fan bearing housing for a ram air fan assembly includes a bearing section, a disk section, and radial support ribs. The disk section is at one end of the bearing section for connecting the bearing section to the ram air fan assembly. The disk section includes an outer ring with a circumferential support rib; and a disk wall connecting the outer ring to the bearing section. The disk wall includes arcuate cooling slots defined by edges, including an arcuate edge having an arc center at an axis of the bearing housing and positioned adjacent to and radially inward from the circumferential support rib. The radial support ribs extend axially along most of the length of the bearing section and extend radially along the disk wall to the circumferential support rib. The radial support ribs and the cooling slots alternate about the axis of the bearing housing.

20 Claims, 6 Drawing Sheets

(56) References Cited

U.S. PATENT DOCUMENTS

| | | | | | |
|---|---|---|---|---|---|
| 3,433,020 | A | | 3/1969 | Earle, Jr. et al. | |
| 3,588,044 | A | | 6/1971 | Reichrath et al. | |
| 3,619,088 | A | * | 11/1971 | Bullock | 417/363 |
| 3,763,835 | A | | 10/1973 | Miller et al. | |
| 3,915,024 | A | | 10/1975 | Mort | |
| 3,949,550 | A | | 4/1976 | Albrecht et al. | |
| 3,999,872 | A | | 12/1976 | Allison | |
| 4,012,154 | A | | 3/1977 | Durwin et al. | |
| 4,439,106 | A | | 3/1984 | Ferris et al. | |
| 4,511,193 | A | | 4/1985 | Geczy | |
| 4,543,785 | A | | 10/1985 | Patrick | |
| 4,952,078 | A | * | 8/1990 | Ankenbauer et al. | 384/476 |
| 4,979,872 | A | | 12/1990 | Myers et al. | |
| 5,239,815 | A | | 8/1993 | Barcza | |
| 5,350,281 | A | * | 9/1994 | Hagshenas | 417/371 |
| 5,505,587 | A | | 4/1996 | Ghetzler | |
| 5,529,316 | A | | 6/1996 | Mattila | |
| 5,683,184 | A | | 11/1997 | Striedacher et al. | |
| 6,299,077 | B1 | | 10/2001 | Harmon et al. | |
| 6,380,647 | B2 | | 4/2002 | Hayashi et al. | |
| 6,698,933 | B2 | | 3/2004 | Lau | |
| 6,926,490 | B2 | | 8/2005 | McAuliffe et al. | |
| 6,928,963 | B2 | | 8/2005 | Karanik | |
| 6,966,174 | B2 | | 11/2005 | Paul | |
| 7,165,939 | B2 | | 1/2007 | Chen et al. | |
| 7,342,332 | B2 | | 3/2008 | McAuliffe et al. | |
| 7,394,175 | B2 | * | 7/2008 | McAuliffe et al. | 310/58 |
| 7,397,145 | B2 | | 7/2008 | Struve et al. | |
| 7,540,663 | B2 | * | 6/2009 | Yum et al. | 384/103 |
| 7,757,502 | B2 | | 7/2010 | Merritt et al. | |
| 7,952,241 | B2 | | 5/2011 | Kato et al. | |
| 8,496,432 | B2 | * | 7/2013 | Beers et al. | 415/180 |
| 2002/0171218 | A1 | | 11/2002 | Bell | |
| 2006/0061221 | A1 | | 3/2006 | McAuliffe et al. | |
| 2010/0055383 | A1 | | 3/2010 | Schalla et al. | |

OTHER PUBLICATIONS

Colson et al., U.S. Appl. No. 13/279,538, filed Oct. 24, 2011.
Rosen et al., U.S. Appl. No. 13/279,488, filed Oct. 24, 2011.
Binek et al., U.S. Appl. No. 13/279,497, filed Oct. 24, 2011.
Binek et al., U.S. Appl. No. 13/279,508, filed Oct. 24, 2011.
Chrabascz et al., U.S. Appl. No. 13/279,523, filed Oct. 24, 2011.
Rosen et al., U.S. Appl. No. 13/279,576, filed Oct. 24, 2011.

* cited by examiner

RAM AIR FAN BEARING HOUSING

BACKGROUND

The present invention relates to an environmental control system. In particular, the invention relates to a bearing housing of a ram air fan assembly for an environmental control system for an aircraft.

An environmental control system (ECS) aboard an aircraft provides conditioned air to an aircraft cabin. Conditioned air is air at a temperature, pressure, and humidity desirable for aircraft passenger comfort and safety. At or near ground level, the ambient air temperature and/or humidity is often sufficiently high that the air must be cooled as part of the conditioning process before being delivered to the aircraft cabin. At flight altitude, ambient air is often far cooler than desired, but at such a low pressure that it must be compressed to an acceptable pressure as part of the conditioning process. Compressing ambient air at flight altitude heats the resulting pressurized air sufficiently that it must be cooled, even if the ambient air temperature is very low. Thus, under most conditions, heat must be removed from air by the ECS before the air is delivered to the aircraft cabin. As heat is removed from the air, it is dissipated by the ECS into a separate stream of air that flows into the ECS, across heat exchangers in the ECS, and out of the aircraft, carrying the excess heat with it. Under conditions where the aircraft is moving fast enough, the pressure of air ramming into the aircraft is sufficient to move enough air through the ECS and over the heat exchangers to remove the excess heat.

While ram air works well under normal flight conditions, at lower flight speeds, or when the aircraft is on the ground, ram air pressure is too low to provide enough air flow across the heat exchangers for sufficient heat removal from the ECS. Under these conditions, a fan within the ECS is employed to provide the necessary airflow across the ECS heat exchangers. This fan is called a ram air fan.

As with any system aboard an aircraft, there is great value in an improved ram air fan that includes innovative components, such as a bearing housing, designed to improve the operational efficiency of the ram air fan or to reduce its weight.

SUMMARY

The present invention is ram air fan bearing housing for a ram air fan assembly. The bearing housing includes a bearing section, a disk section, and a plurality of radial support ribs. The bearing section includes a cylindrical interior for containing a journal bearing. The cylindrical interior is symmetrical about an axis of the bearing housing. The disk section is at one end of the bearing section and is perpendicular to the axis of the bearing housing for connecting the bearing section to the ram air fan assembly. The disk section includes an outer ring and a disk wall. The outer ring is at an edge of the disk section opposite the bearing section. The outer ring includes a plurality of bolt holes and a circumferential support rib radially inward from the bolt holes. The disk wall connects the outer ring to the bearing section. The disk wall includes a plurality of arcuate cooling slots. Each cooling slot is defined by a plurality of edges, including a first arcuate edge. The first arcuate edge is positioned adjacent to and radially inward from the circumferential support rib. The first arcuate edge has an arc center at the axis of the bearing housing. The plurality of radial support ribs extend axially along most of the length of the bearing section and extend radially along the disk wall from the bearing section to the circumferential support rib. The radial support ribs are spaced equally about the axis of the bearing housing. The plurality of radial support ribs and the plurality of arcuate cooling slots alternate about the axis of the bearing housing.

DETAILED DESCRIPTION

The present invention is a bearing housing for a ram air fan that efficiently supplies a flow of cooling air to a motor stator and a journal bearing while providing mechanical support for the journal bearing and a journal bearing shaft. Arcuate cooling slots near the periphery of the bearing housing efficiently distribute a flow of cooling air from the inner housing to the motor stator. The flow is sufficient to keep the motor stator cool, without excessive cooling. Such excessive cooling is a wasteful reduction by the ram air fan assembly on the overall efficiency of the environmental control system. The arcuate cooling slots are positioned and sized to provide the efficient distribution of cooling air. In addition, because cooling air also must flow through the journal bearing, the ratio of the area of the arcuate cooling slots to the area of a cylindrical interior for containing the journal bearing provides for an efficient split of cooling flow from the inner housing, with sufficient, but not excessive, cooling of both the motor stator and the journal bearing. Finally, a plurality of radial support ribs provides mechanical strength to the bearing housing sufficient to mechanically support the journal bearing and the journal bearing shaft. The use of a plurality of radial support ribs provides the mechanical support without adding unnecessary weight, thereby providing additional efficiency in the operation of the ram air fan assembly and the environmental control system.

Figure 1:
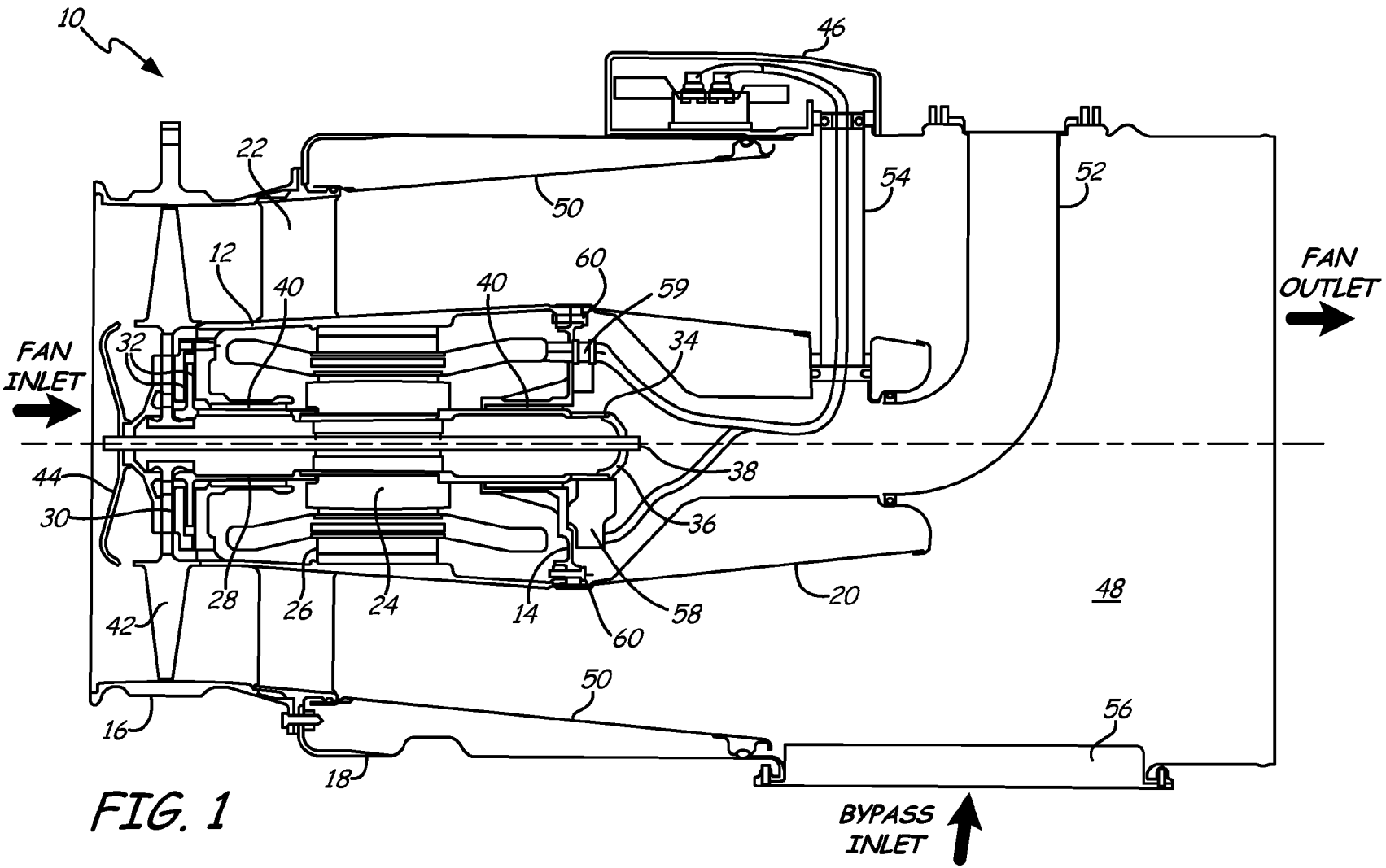
FIG. 1 is a side view of a ram air fan assembly incorporating the present invention.

FIG. 1 illustrates a ram air fan air assembly incorporating the present invention. FIG. 1 shows ram air fan assembly 10 including fan housing 12, bearing housing 14, inlet housing 16, outer housing 18, and inner housing 20. Fan housing 12 includes fan struts 22, motor rotor 24, motor stator 26, thrust shaft 28, thrust plate 30, and thrust plate 32. Bearing housing 14 includes journal bearing shaft 34 and shaft cap 36. Fan housing 12 and bearing housing 14 together include tie rod 38 and journal bearings 40. Inlet housing 16 contains fan rotor 42 and inlet shroud 44, in addition to a portion of tie rod 38. Outer housing 18 includes terminal box 46 and plenum 48. Within outer housing 18 are diffuser 50, motor bearing cooling tube 52, wire transfer tube 54, check valve 56, speed sensor 58, and wire clamp 59. A fan inlet is a source of air to be moved by ram air fan assembly 10 in the absence of sufficient ram air pressure. A bypass inlet is a source of air to that moves through ram air fan assembly 10 when sufficient ram air pressure is available.

As illustrated in FIG. 1, inlet housing 16 and outer housing 18 are attached to fan housing 12 at fan struts 22. Bearing housing 14 is attached to fan housing 12 with bolts 60. Inner housing 20 connects motor bearing cooling tube 52 and wire transfer tube 54 to bearing housing 14. Motor bearing cooling tube 52 connects inner housing 20 to a source of cooling air at outer housing 18. Wire transfer tube 54 connects inner housing 20 to outer housing 18 at terminal box 46. Motor stator 26 and thrust plate 30 attach to fan housing 12. Motor rotor 24 is contained within motor stator 26 and connects journal bearing shaft 34 to thrust shaft 28. Journal bearing shaft 34, motor rotor 24, and thrust shaft 28 define an axis of rotation for ram air fan assembly 10. Fan rotor 42 is attached to thrust shaft 28 with tie rod 38 extending along the axis of rotation from shaft cap 36 at the end of journal bearing shaft 34 through motor rotor 24, thrust shaft 38, and fan rotor 42 to inlet shroud 44. Nuts (not shown) secure shaft cap 36 to journal bearing shaft 34 on one end of tie rod 38 and inlet shroud 44 to fan rotor 42 at opposite end of tie rod 38. Thrust plate 30 and fan housing 12 contain a flange-like portion of thrust shaft 28, with thrust bearings 32 positioned between the flange-like portion of thrust shaft 28 and thrust plate 30; and between the flange-like portion of thrust shaft 28 and fan housing 12. Journal bearings 40 are positioned between journal bearing shaft 24 and bearing housing 14; and between thrust shaft 28 and fan housing 12. Inlet shroud 44, fan rotor 42, and a portion of fan housing 12 are contained within inlet housing 16. Diffuser 50 is attached to an inner surface of outer housing 18. Speed sensor 58 is attached to bearing housing 14. Plenum 48 is a portion of outer housing 18 that connects ram air fan assembly 10 to check valve 56 and the bypass inlet. Inlet housing 16 is connected to the fan inlet and outer housing 18 is connected to the fan outlet.

In operation, ram air fan assembly 10 is installed into an environmental control system aboard an aircraft and connected to the fan inlet, the bypass inlet, and the fan outlet. When the aircraft does not move fast enough to generate sufficient ram air pressure to meet the cooling needs of the ECS, power is supplied to motor stator 26 by wires running from terminal box 46, through wire transfer tube 54, inner housing 20, and bearing housing 14. Energizing motor stator 26 causes rotor 24 to rotate about the axis of rotation for ram air fan assembly 10, rotating connected journal bearing shaft 34 and thrust shaft 28. Speed sensor 58 measures the rate of rotation of journal bearing shaft 34. Fan rotor 42 and inlet shroud 44 also rotate by way of their connection to thrust shaft 28. Journal bearings 40 and thrust bearings 32 provide low friction support for the rotating components. As fan rotor 42 rotates, it moves air from the fan inlet, through inlet housing 20, past fan struts 22 and into the space between fan housing 12 and outer housing 18, increasing the air pressure in outer housing 18. As the air moves through outer housing 18, the air flows past diffuser 50 and inner housing 20, where the air pressure is reduced due to the shape of diffuser 50 and the shape of inner housing 20. Once past inner housing 20, the air moves out of outer housing 18 at the fan outlet. Check valve 56 remains closed to prevent air moving out of outer housing 18 and into the bypass inlet.

Components within bearing housing 14 and fan housing 12, especially thrust bearings 32, journal bearings 40, motor stator 26, and motor rotor 24; generate significant heat and must be cooled. Cooling air is provided by motor bearing cooling tube 52 which directs a flow of cooling air to inner housing 20. Inner housing 20 directs flow of cooling air to bearing housing 14, where it flows past components in bearing housing 14 and fan housing 12, cooling the components. Once the aircraft moves fast enough to generate sufficient ram air pressure to meet the cooling needs of the ECS, check valve 56 opens, and ram air is directed into plenum 48 from the bypass inlet. The ram air passes into outer housing 18 at plenum 48 and moves out of outer housing 18 at the fan outlet.

Figure 2:
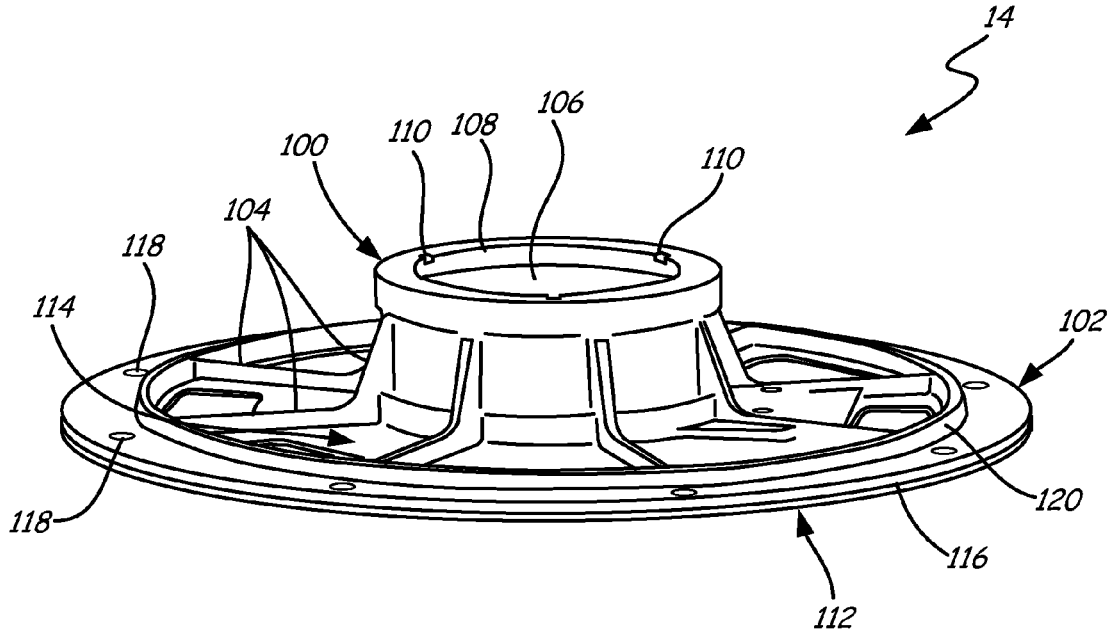
FIG. 2 is a perspective view of a bearing housing incorporating the present invention.

FIG. 2 is a perspective view of an embodiment of bearing housing 14 incorporating the present invention. As shown in FIG. 2, bearing housing 14 includes bearing section 100, disk section 102, and a plurality of radial support ribs 104. Bearing section 100 includes cylindrical interior 106, bearing shoulder 108, and a plurality of bearing removal slots 110. Disk section 102 includes outer ring 112 and disk wall 114. Outer ring 112 includes o-ring channel 116, a plurality of bolt holes 118, and circumferential support rib 120.

Cylindrical interior 106 is a hollow, cylindrical space within bearing section 100 for containing journal bearing 40, as shown in FIG. 1. Cylindrical interior 106 is symmetrical about an axis of bearing housing 14. Disk section 102 is perpendicular to the axis of bearing housing 14 and connected to an end of bearing section 100. Outer ring 112 is at the edge of disk section 102 opposite bearing section 100. O-ring channel 116 is at the most radially extreme portion of outer ring 112 and extends around the entire outer circumference of outer ring 112. Bolt holes 118 are radially inward from o-ring channel 116 and are spaced along outer ring 112 to match a pattern of bolt holes (not shown) in fan housing 12. Circumferential support rib 120 is radially inward from bolt holes 118 and extends around the entire inner circumference of outer ring 112. Disk wall 114 extends from circumferential support rib 120 to bearing section 100, connecting outer ring 112 to bearing section 100. Bearing shoulder 108 is at another end of bearing section 100, opposite the end connected to disk section 102. Bearing removal slots 110 are openings in bearing shoulder 108. Each of radial support ribs 104 extend axially along most of the length of bearing section 100 and radially along disk wall 114 from bearing section 100 to circumferential support rib 120. In the embodiment of FIG. 2, bearing housing 14 is a machined casting of a high strength, lightweight metal, for example a high-temperature aluminum alloy.

In operation, bearing section 100 contains journal bearing 40, which provides low friction support for journal bearing shaft 34, as described above in reference to FIG. 1. Bearing section 100 is supported by disk section 102 by virtue of its connection to fan housing 12, which is held in place by bolts 60 through bolt holes 118. Circumferential support rib 120 and radial support ribs 104 provide sufficient mechanical strength without adding unnecessary weight, as described below in reference to FIGS. 5 and 6.

Figure 3:
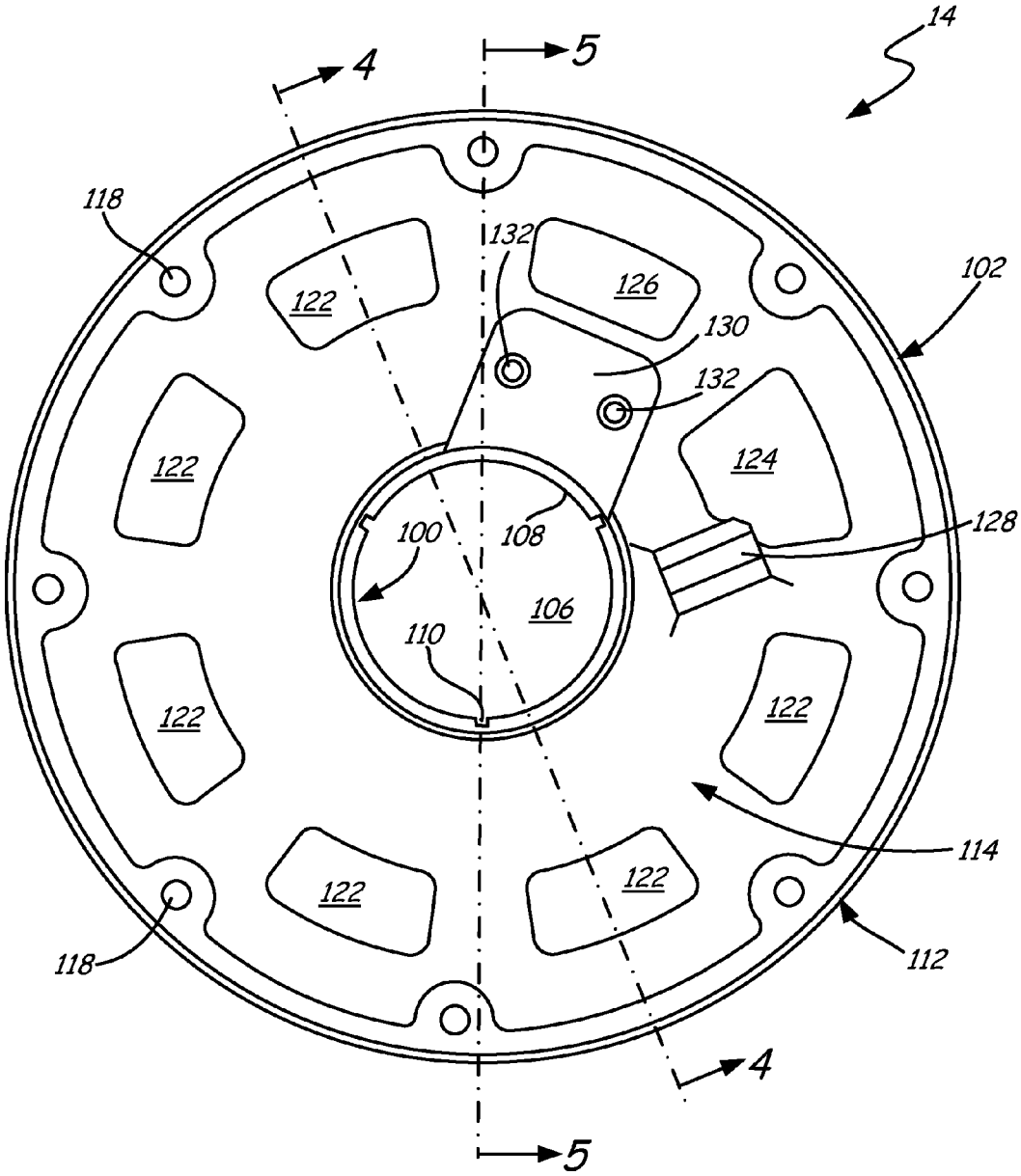
FIG. 3 is an end view of the bearing housing of FIG. 2.

FIG. 3 is an end view of bearing housing 14 of FIG. 2 showing a side of disk section 102 facing away from bearing section 100. FIG. 3 illustrates additional features of a bearing housing of the present invention. As shown in FIG. 3, disk wall 114 also includes medium cooling slots 122, large cooling slot 124, small cooling slot 126, power cable clamp lug 128, speed sensor recess 130, and speed sensor attachment holes 132. Medium cooling slots 122, large cooling slot 124, and small cooling slot 126 are arcuate (arc shaped) openings in disk wall 114, each with an arc center at the axis of bearing housing 14. Power cable clamp lug 128 is a feature in disk wall 114 to which wire clamp 59 is attached to provide strain relief for the wires running through bearing housing 14 to motor stator 26, as described above in reference to FIG. 1. Speed sensor recess 130 accommodates and aligns speed sensor 58, which is attached to bearing housing 14 to monitor the speed of journal bearing shaft 34, as described above. Speed sensor attachment holes 132 are threaded connections for securing speed sensor 58 to bearing housing 14.

As shown in FIG. 3, large cooling slot 124 is the cooling slot adjacent to power cable clamp lug 128. Large cooling slot 124 is larger to accommodate the passage of the wires running though bearing housing 14 and supported by power cable clamp lug 128. Small cooling slot 126 is the cooling slot adjacent to speed sensor recess 130. Small cooling slot 126 is smaller to provide sufficient room for speed sensor 58. All medium cooling slots 122 are identical and intermediate in size between small cooling slot 126 and large cooling slot 124, as described in detail below in reference to FIG. 6. Arcuate cooling slots 122, 124, 126 are positioned equally about the axis of bearing housing 14 to provide a path for the flow of cooling air from inner housing 20 to components of fan housing 12, specifically motor stator 26, as described above in reference to FIG. 1.

Figure 4:
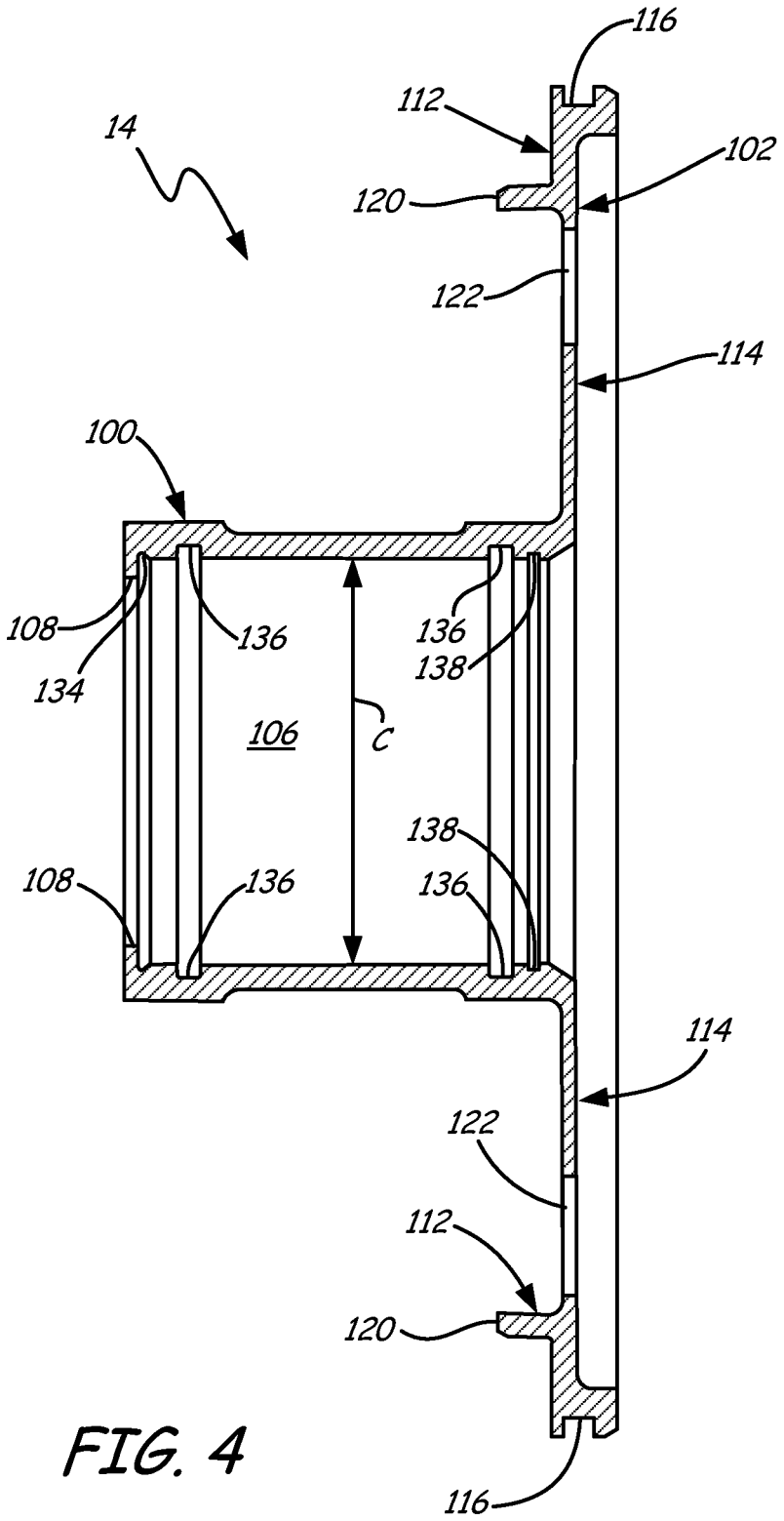
FIG. 4 is a longitudinal cross-sectional view of the bearing housing of FIG. 3.

FIG. 4 is a longitudinal cross-sectional view of bearing housing 14 of FIG. 3. The cross-section is through the axis of bearing housing 14 and bisects two medium cooling slots 122. As shown in FIG. 4, cylindrical interior 106 of cylinder section 100 includes shoulder recess 134, o-ring seal grooves 136, and snap ring groove 138. Shoulder recess 134, o-ring seal grooves 136, and snap ring groove 138 extend around cylindrical interior 106. Considering FIGS. 1 and 4 together, in operation, o-ring seal grooves 136 accommodate o-ring seals (not shown) between journal bearing 40 and cylinder section 100 to support journal bearing 40. Bearing shoulder 108 holds journal bearing 40 in axial position on one end, with shoulder recess 134 preventing a corner with a radius of curvature from interfering with fully seating journal bearing 40 against bearing shoulder 108. Journal bearing 40 is held in axial position on an end opposite bearing shoulder 108 by a snap ring (not shown) inserted into snap ring groove 138. Cylindrical interior 106 has a diameter C that determines a cross-sectional area in a plane perpendicular to the axis of bearing housing 14 available to accommodate journal bearing 40. In the embodiment shown in FIG. 4, diameter C is about 2.261 inches (or about 57.43 mm). In another embodiment, diameter C is between 2.260 inches and 2.262 inches (or between 57.40 mm and 57.46 mm).

Figure 5:
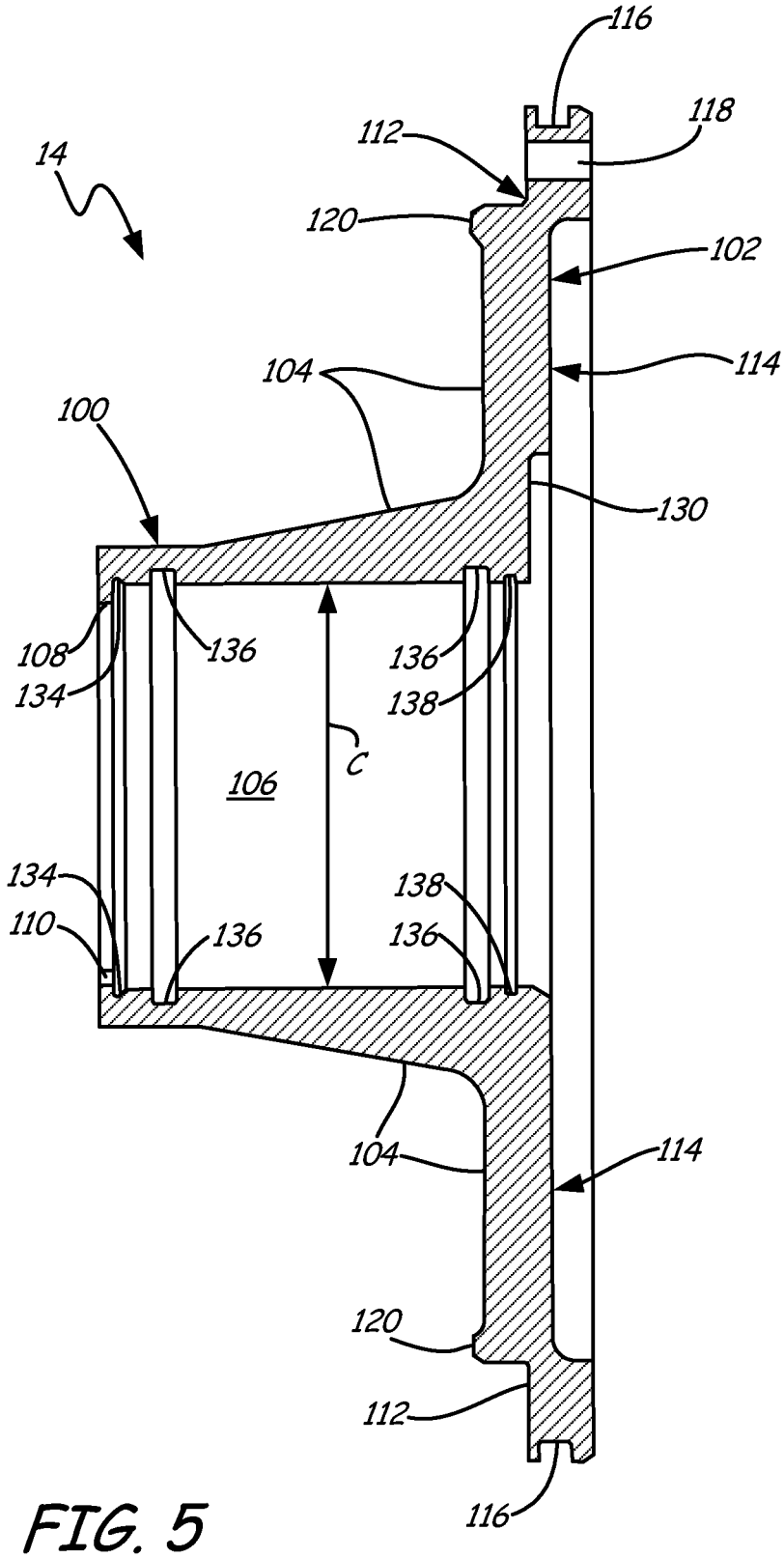
FIG. 5 is another longitudinal cross-sectional view of the bearing housing of FIG. 3.

FIG. 5 is another longitudinal cross-sectional view of the bearing housing of FIG. 3. The cross-section is through the axis of bearing housing 14 and bisects one of radial support ribs 104. As shown in FIG. 5, radial support rib 104 extends axially along most of the length of bearing section 100 to provide mechanical support for bearing section 100. Radial support rib 104 also extends radially along disk wall 114 to circumferential support rib 120. This cross-section also shows bolt hole 118 on one side of outer ring 112, but not on the other side. This offset of one bolt hole 118 matches the pattern of fan housing 12 and ensures that bearing housing 14 is bolted to fan housing 12 in a consistent orientation. FIG. 5 also shows one of bearing removal slots 110. As noted above, bearing removal slots 110 are openings in bearing shoulder 108. Inserting a bearing removal tool (not shown) into bearing removal slots 110 assists in removing journal bearing 40 from cylindrical interior 106 of bearing section 100.

Figure 6:
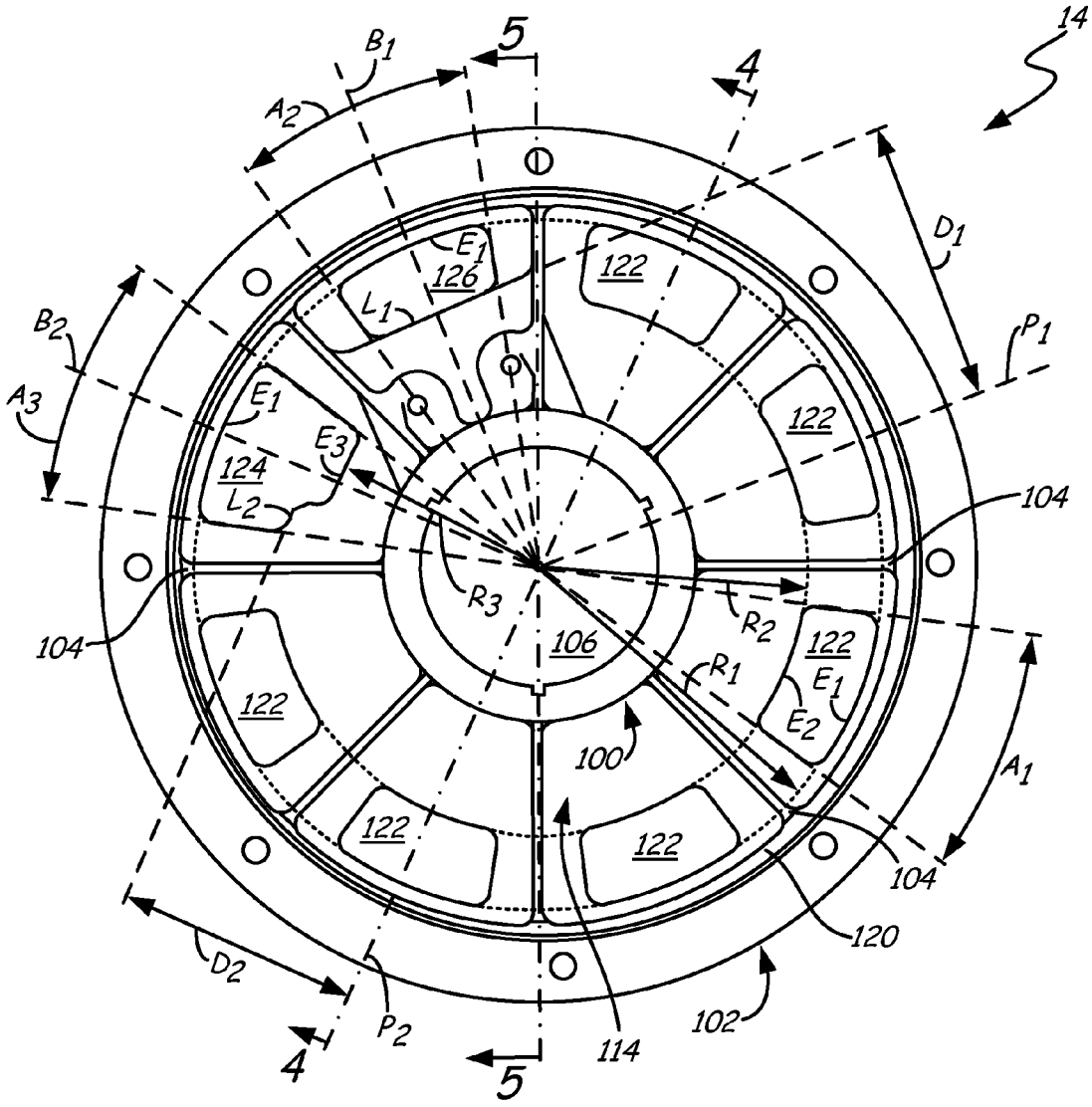
FIG. 6 is another end view of the bearing housing of FIG. 2.

FIG. 6 is an end view of bearing housing 14 of FIG. 2 showing a side of disk section 102 facing toward bearing section 100. FIG. 6 illustrates additional features of a bearing housing of the present invention. As shown in FIG. 6, radial support ribs 104 are spaced equally about the axis of bearing housing 14 to provide sufficient mechanical strength without adding unnecessary weight. Each of radial support ribs 104 is between two of arcuate cooling slots 122, 124, 126 such that arcuate cooling slots 122, 124, 126 and radial support ribs 104 alternate about the axis of bearing housing 14. Also shown in FIG. 6 are innovative details about the size, shape, and positioning of arcuate cooling slots 122, 124, 126. Each of arcuate cooling slots 122, 124, 126 extends about the axis of bearing housing 14 for an angular distance of at least about 28 degrees. In the embodiment of FIG. 6, medium cooling slots 122 extend for angular distance A1 of about 28 degrees, small cooling slot 126 extends for angular distance A2 of about 28 degrees, and large cooling slot 124 extends for angular distance A3 of about 29 degrees. In another embodiment, angular distance A1 is between 27.14 degrees and 28.86 degrees, angular distance A2 is also between 27.14 degrees and 28.86, and angular distance A3 is between 28.14 degrees and 29.86 degrees.

As illustrated in FIG. 6, each of arcuate cooling slots 122, 124, 126 is defined by a plurality of edges. Medium cooling slots 122, large cooling slot 124, and small cooling slot 126 each include first arcuate edge E1. First arcuate edge E1 has an arc center at the axis of bearing housing 14 and is the one of the plurality of edges that is nearest circumferential support rib 120, at a first radial distance R1 from the axis of bearing housing 14. In the embodiment shown in FIG. 5, R1 is about 2.97 inches (or about 75.4 mm). In another embodiment, R1 is between 2.92 inches and 3.01 inches (or between 74.3 mm and 76.6 mm).

FIG. 6 shows that medium cooling slots 122 also each include second arcuate edge E2. Second arcuate edge E2 has an arc center at the axis of bearing housing 14 and is radially inward from first arcuate edge E1 at a second radial distance R2 from the axis of bearing housing 14. Small cooling slot 126 also includes first linear edge L1 positioned radially inward from first arcuate edge E1. First linear edge L1 is parallel to a first plane P1 at a first linear distance D1 from first plane P1. First plane P1 contains the axis of the bearing housing 14 and is perpendicular to bisecting plane B1. Bisecting plane B1 is a plane bisecting small cooling slot 126 and also containing the axis of bearing housing 14. Large cooling slot 124 also includes third arcuate edge E3 and second linear edge L2. Third arcuate edge E3 has an arc center at the axis of bearing housing 14 and is radially inward from first arcuate edge E1 at a third radial distance R3 from the axis of bearing housing 14. Second linear edge L2 is positioned radially inward from first arcuate edge E1 and is parallel to a second plane P2 at a second linear distance D2 from first plane P2. Second plane P2 contains the axis of bearing housing 14 and is perpendicular to bisecting plane B2. Bisecting plane B2 is a plane bisecting large cooling slot 124 and also containing the axis of bearing housing 14.

In the embodiment of the present invention illustrated in FIG. 6, second radial distance R2 is about 2.30 inches (or about 58.4 mm); third radial distance R3 is about 1.89 inches (or about 48.0 mm); first linear distance D1 is about 2.35 inches (or about 59.6 mm); and second linear distance D2 is about 2.15 inches (or about 54.6 mm). In another embodiment of the present invention, second radial distance R2 is between 2.26 inches and 2.35 inches (or between 57.3 mm and 59.6 mm); third radial distance R3 is between 1.85 inches and 1.94 inches (or between 46.9 mm and 49.1 mm); first linear distance D1 is between 2.30 inches and 2.39 inches (or between 58.4 mm and 60.7 mm); and second linear distance D2 is between 2.11 inches and 2.20 inches (or between 53.5 mm and 55.8 mm).

Considering FIGS. 1 and 6 together, the total area of disk wall 114 represents the maximum area available for cooling slots to provide cooling to motor stator 26. As can be seen from FIG. 6, arcuate cooling slots 122, 124, 126 occupy only a portion of the total area of disk wall 114. Embodiments of the present invention require only a portion of the total area of disk wall 114 include cooling slots to provide an efficient level of cooling to motor stator 26. Should the percentage of the total area of disk wall 114 opened up by the plurality of cooling slots 122, 124, 126 be too great, inefficiency results due to overcooling of motor stator 26. Conversely, should the percentage of the total area of disk wall 114 opened up by the plurality of cooling slots 122, 124, 126 be too small, motor stator 26 would overheat. Thus, the percentage of the total area of disk wall 114 opened up by the plurality of cooling slots 122, 124, 126 is a ratio critical to the efficient operation of ram air fan assembly 10. In the embodiment illustrated in FIG. 6, a ratio of a total area of arcuate cooling slots 122, 124, 126 to the total area of disk wall 114 is about 30%. In another embodiment, the ratio of the total area of arcuate cooling slots 122, 124, 125 to the total area of disk wall 114 is between 23% and 37%.

As noted above, arcuate cooling slots 122, 124, 126 are positioned equally about the axis of bearing housing 14 to provide a path for the flow of cooling air from inner housing 20 to components of fan housing 12, specifically motor stator 26, as described above in reference to FIG. 1. As also described above in reference to FIG. 1, a flow of cooling air from inner housing 20 is also directed to journal bearing 40. The flow of cooling air from inner housing 20 is necessarily split between a total area of arcuate cooling slots 122, 124, 126 and a cross-sectional area of cylindrical interior 106 in a plane perpendicular to the axis of bearing housing 14. The split of the cooling air flow between these two paths is critical for keeping motor stator 26 and journal bearing 40 sufficiently cool, without providing excess cooling to either. Such excess cooling is a wasteful drag by ram air fan assembly 10 on the overall efficiency of the environmental control system, which must work harder to provide the excess cooling. Therefore, a ratio of the total area of arcuate cooling slots 122, 124, 126 to the cross-sectional area of cylindrical interior 106 in a plane perpendicular to the axis of bearing housing 14 is another ratio critical to the efficient operation of ram air fan assembly 10. The ratio of the total area of arcuate cooling slots 122, 124, 126 to the cross-sectional area of cylindrical interior 106 for an embodiment described above in reference to FIGS. 6 and 4, respectively, is about 1.8. In other embodiments, this ratio is between 1.48 and 2.17.

As shown in FIG. 1, bearing housing 14 is accessible from the fan outlet end of ram air fan assembly 10, which greatly simplifies replacement of bearing housing 14, beginning with removal of ram air fan assembly 10 from the aircraft. Ram air fan assembly 10 is a line-replaceable unit (LRU). LRUs are designed to be installed and removed easily and efficiently such that a new unit can replace a unit in need of repair or inspection quickly, getting the aircraft back into service while the LRU removed is taken elsewhere for repair or inspection. Considering FIGS. 1 and 2 together, removal of bearing housing 14 from ram air fan assembly 10 begins by disconnecting motor bearing cooling tube 52 from inner housing 20. Next, electrical wires are disconnected from terminal box 46 and pulled into inner housing 20. Wire transfer tube 54 is then disconnected from inner housing 20 and inner housing 20 is pulled away from bearing housing 14. Bolts 60 are removed from bolt holes 118 and a snap ring (not shown) is removed from snap ring groove 138. Wire clamp 59 is disconnected from power cable clamp lug 128 to release the electrical wires. Bearing housing 14 including journal bearing 40 is slid out from around journal bearing shaft 34 while the electrical wire slips through large cooling slot 124. A bearing removal tool (not shown) is inserted into bearing removal slots 110 to remove journal bearing 40 from cylindrical interior 106 of bearing section 100. Finally, bearing housing 14 is removed from ram air fan assembly 10 through the fan outlet end of ram air fan assembly 10.

Installing bearing housing 14 begins with orienting bearing housing 14 such that bearing section 100 faces the fan outlet end of ram air fan assembly 10 before inserting bearing housing into the fan outlet end. Bearing housing 14 is inserted into the fan outlet end such that bearing section 100 axially surrounds journal bearing shaft 34 and disk section 102 fits against fan housing 12. Bearing housing 14 is aligned against fan housing 12 such that bolt holes 118 align with matching bolt holes in fan housing 12. Bolts 60 are inserted through bolt holes 118 and bearing housing 14 is bolted to fan housing 12. Journal bearing 40 is installed into cylindrical interior 106 of bearing section 100 between journal bearing shaft 34 and bearing housing 14 by pressing journal bearing 40 up against bearing shoulder 108 and securing with the snap ring inserted into snap ring groove 138. Speed sensor 58 is attached to bearing housing 14 at speed sensor recess 130 with bolts (not shown) connecting to speed sensor attachment holes 132. Next, the electrical wires from fan housing 12 are fed through large cooling slot 124 and secured to power cable clamp lug 128 with wire clamp 59. The electrical wires are pulled into inner housing 20 while inner housing 20 is attached to bearing housing 14 at an o-ring seal in o-ring channel 116 around disc section 102. Next, wire transfer tube 54 is connected to inner housing 20, and then the electrical wires are fed through wire transfer tube 54 to terminal box 46, where the electrical wires are connected to terminal box 46. Motor bearing cooling tube 52 is connected to inner housing 20 such that a flow of cooling air from motor bearing cooling tube 52 flows from inner housing 20 through medium cooling slots 122, large cooling slot 124, and small cooling slot 126 to provide cooling to motor stator 26 and through cylindrical interior 106 of bearing section 100 to provide cooling to journal bearing 40 to complete the installation of bearing housing 14 into ram air fan assembly 10. The final step is installing ram air fan assembly 10 with newly installed replacement bearing housing 14 back into the aircraft.

A bearing housing for a ram air fan of the present invention efficiently supplies a flow of cooling air to a motor stator and a journal bearing while providing mechanical support for the journal bearing and a journal bearing shaft. The arcuate cooling slots described above efficiently distribute a flow of cooling air from the inner housing to the motor stator. The flow is sufficient to keep the motor stator cool, without excessive cooling. Such excessive cooling is a wasteful reduction by the ram air fan assembly on the overall efficiency of the environmental control system. In addition, because cooling air also must flow through the journal bearing, the ratio of the area of the arcuate cooling slots to the area of a cylindrical interior for containing the journal bearing provides for an efficient split of cooling flow from the inner housing, with sufficient, but not excessive, cooling of both the motor stator and the journal bearing. Finally, a plurality of radial support ribs extending axially along most of the length of the bearing section and radially along the disk wall to the circumferential support rib provides mechanical strength to the bearing housing sufficient to mechanically support the journal bearing and the journal bearing shaft. By employing the radial support ribs spaced equally about the axis of the bearing housing, the mechanical support is provided without adding unnecessary weight, thereby providing additional efficiency in the operation of the ram air fan assembly and the environmental control system.

Novel aspects of bearing housing 14, including bearing section 100 and disk section 102 of the present invention described herein are achieved by substantial conformance to specified geometries. It is understood that edge breaks and curved radii not specifically described herein, but normally employed in the art, may be added to bearing housing 14 to enhance manufacturability, ease assembly, or improve durability while retaining substantial conformance to specified geometries.

Alternatively, substantial conformance is based on a determination by a national or international regulatory body, for example in a part certification or parts manufacture approval (PMA) process for the Federal Aviation Administration, the European Aviation Safety Agency, the Civil Aviation Administration of China, the Japan Civil Aviation Bureau, or the Russian Federal Agency for Air Transport. In these embodiments, substantial conformance encompasses a determination that a particular ram air fan bearing housing is identical to, or sufficiently similar to, the specified bearing housing 14 comprising bearing section 100 and disk section 102, or that the ram air fan bearing housing is sufficiently the same with respect to a part design in a type-certified ram air fan bearing housing, such that the ram air fan bearing housing complies with airworthiness standards applicable to the specified ram air fan bearing housing. In particular, substantial conformance encompasses any regulatory determination that a particular part or structure is sufficiently similar to, identical to, or the same as a specified bearing housing 14 of the present invention, such that certification or authorization for use is based at least in part on the determination of similarity.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A ram air fan bearing housing for a ram air fan assembly, the bearing housing comprising:

a bearing section comprising a cylindrical interior symmetrical about an axis of the bearing housing; the cylindrical interior for containing a journal bearing;

a disk section at one end of the bearing section and perpendicular to the axis of the bearing housing, the disk section for connecting the bearing section to the ram air fan assembly, the disk section comprising:

an outer ring at an edge of the disk section opposite the bearing section, the outer ring comprising:

a plurality of bolt holes; and a circumferential support rib radially inward from the plurality of bolt holes; and a disk wall connecting the outer ring to the bearing section, the disk wall comprising:

a plurality of arcuate cooling slots, each cooling slot defined by a plurality of edges including a first arcuate edge; the first arcuate edge positioned adjacent to and radially inward from the circumferential support rib at a first radial distance from the axis of the bearing housing; the first arcuate edge having an arc center at the axis of the bearing housing; and a plurality of radial support ribs extending axially along most of the length of the bearing section, and extending radially along the disk wall from the bearing section to the circumferential support rib; the plurality of radial support ribs spaced equally about the axis of the bearing housing; the plurality of radial support ribs and the plurality of arcuate cooling slots alternating about the axis of the bearing housing.

2. The bearing housing of claim 1, wherein a ratio of a total area of the plurality of arcuate cooling slots to a cross-sectional area of the cylindrical interior in a plane perpendicular to the axis of the bearing housing is about 1.8.

3. The bearing housing of claim 1, wherein a ratio of a total area of the plurality of arcuate cooling slots to a cross-sectional area of the cylindrical interior in a plane perpendicular to the axis of the bearing housing is between 1.48 and 2.17.

4. The bearing housing of claim 1, wherein a ratio of a total area of the plurality of arcuate cooling slots to a total area of the disk wall is about 30 percent.

5. The bearing housing of claim 1, wherein a ratio of a total area of the plurality of arcuate cooling slots to a total area of the disk wall is between 23 percent and 37 percent.

6. The bearing housing of claim 1, wherein the first radial distance is about 2.97 inches (or about 75.4 mm).

7. The bearing housing of claim 1, wherein the first radial distance is between 2.92 inches and 3.01 inches (or between 74.3 mm and 76.6 mm).

8. The bearing housing of claim 1, wherein each of the plurality of arcuate cooling slots extend at least about 28 degrees about the axis of the bearing housing.

9. The bearing housing of claim 1, wherein the plurality of arcuate cooling slots comprise:

seven cooling slots, each extending between 27.14 degrees and 28.86 degrees about the axis of the bearing housing; and a large cooling slot extending between 28.14 and 29.86 degrees about the axis of the bearing housing.

10. The bearing housing of claim 9, wherein:

the seven cooling slots comprise:

six medium cooling slots, each of the medium cooling slots further comprising:

a second arcuate edge radially inward from the first arcuate edge at a second radial distance from the axis of the bearing housing, the second arcuate edge having an arc center at the axis of the bearing housing; and a small cooling slot, the small cooling slot further comprising:

a first linear edge radially inward from the first arcuate edge, the first linear edge being parallel to a first plane containing the axis of the bearing housing; the first plane perpendicular to a plane bisecting the small cooling slot and also containing the axis of the bearing housing; the first linear edge at a first linear distance from the first plane; and the large cooling slot further comprises:

a third arcuate edge radially inward from the first arcuate edge at a third radial distance from the axis of the bearing housing, the third arcuate edge having an arc center at the axis of the bearing housing; and a second linear edge radially inward from the first arcuate edge; the second linear edge being parallel to a second plane containing the axis of the bearing housing; the second plane perpendicular to a plane bisecting the large cooling slot and also containing the axis of the bearing housing; the second linear edge at a second linear distance from the second plane.

11. The bearing housing of claim 10, wherein the second radial distance is about 2.30 inches (or about 58.4 mm); the third radial distance is about 1.89 inches (or about 48.0 mm);

the first linear distance is about 2.35 inches (or about 59.6 mm); and the second linear distance is about 2.15 inches (or about 54.6 mm).

12. The bearing housing of claim 10, wherein the second radial distance is between 2.26 inches and 2.35 inches (or between 57.3 mm and 59.6 mm); the third radial distance is between 1.85 inches and 1.94 inches (or between 46.9 mm and 49.1 mm); the first linear distance is between 2.30 inches and 2.39 inches (or between 58.4 mm and 60.7 mm); and the second linear distance is between 2.11 inches and 2.20 inches (or between 53.5 mm and 55.8 mm).

13. A ram air fan assembly comprising:
- a fan housing;
- a fan motor attached to the fan housing;
- a fan rotor;
- a thrust shaft connecting the fan motor to the fan rotor;
- a journal bearing shaft connected to fan motor and the thrust shaft;
- an inner housing; and
- a bearing housing attached to the fan housing and connected to the inner housing, the bearing housing containing a journal bearing axially about the journal bearing shaft, the bearing housing comprising:
  - a bearing section comprising a cylindrical interior symmetrical about an axis of the bearing housing; the cylindrical interior for containing a journal bearing;
  - a disk section at one end of the bearing section and perpendicular to the axis of the bearing housing, the disk section for connecting the bearing section to the ram air fan assembly, the disk section comprising:
    - an outer ring at an edge of the disk section opposite the bearing section, the outer ring comprising:
      - a plurality of bolt holes for attaching the bearing housing to the fan housing;
      - an o-ring channel radially outward from the plurality of bolt holes for containing an o-ring seal for connecting the bearing housing to the inner housing; and
      - a circumferential support rib radially inward from the plurality of bolt holes; and
    - a disk wall connecting the outer ring to the bearing section, the disk wall comprising:
      - a plurality of arcuate cooling slots, each cooling slot defined by a plurality of edges including a first arcuate edge; the first arcuate edge positioned adjacent to and radially inward from the circumferential support rib at a first radial distance from the axis of the bearing housing; the first arcuate edge having an arc center at the axis of the bearing housing; and
  - a plurality of radial support ribs extending axially along most of the length of the bearing section, and extending radially along the disk wall from the bearing section to the circumferential support rib; the plurality of radial support ribs spaced equally about the axis of the bearing housing; the plurality of radial support ribs and the plurality of arcuate cooling slots alternating about the axis of the bearing housing.

14. The ram air fan assembly of claim 13, wherein a ratio of a total area of the plurality of arcuate cooling slots to a cross-sectional area of the cylindrical interior in a plane perpendicular to the axis of the bearing housing is about 1.8.

15. The ram air fan assembly of claim 13, wherein a ratio of a total area of the plurality of arcuate cooling slots to a total area of the disk wall is about 30 percent.

16. The ram air fan assembly of claim 13, wherein the first radial distance is about 2.97 inches (or about 75.4 mm).

17. The ram air fan assembly of claim 14, wherein the plurality of arcuate cooling slots comprise:
- seven cooling slots, each extending between 27.14 degrees and 28.86 degrees about the axis of the bearing housing; and
- a large cooling slot extending between 28.14 and 29.86 degrees about the axis of the bearing housing.

18. The ram air fan assembly of claim 17, wherein:
- the seven cooling slots comprise:
  - six medium cooling slots, each of the medium cooling slots further comprising:
    - a second arcuate edge radially inward from the first arcuate edge at a second radial distance from the axis of the bearing housing, the second arcuate edge having an arc center at the axis of the bearing housing; and
  - a small cooling slot, the small cooling slot further comprising:
    - a first linear edge radially inward from the first arcuate edge, the first linear edge being parallel to a first plane containing the axis of the bearing housing; the first plane perpendicular to a plane bisecting the small cooling slot and also containing the axis of the bearing housing; the first linear edge at a first linear distance from the first plane; and
- the large cooling slot further comprises:
  - a third arcuate edge radially inward from the first arcuate edge at a third radial distance from the axis of the bearing housing, the third arcuate edge having an arc center at the axis of the bearing housing; and
  - a second linear edge radially inward from the first arcuate edge; the second linear edge being parallel to a second plane containing the axis of the bearing housing; the second plane perpendicular to a plane bisecting the large cooling slot and also containing the axis of the bearing housing; the second linear edge at a second linear distance from the second plane.

19. The ram air fan assembly of claim 18, wherein the second radial distance is about 2.30 inches (or about 58.4 mm); the third radial distance is about 1.89 inches (or about 48.0 mm); the first linear distance is about 2.35 inches (or about 59.6 mm); and the second linear distance is about 2.15 inches (or about 54.6 mm).

20. A method for installing a ram air fan bearing housing in a ram air fan assembly, the bearing housing comprising a disk section including a plurality of medium cooling slots, a small cooling slot and a large cooling slot; and a bearing section including a cylindrical interior for containing a journal bearing, the method comprising:
- orienting the bearing housing such that the bearing section faces a fan outlet of the ram air fan assembly;
- inserting the bearing housing into the fan outlet such that the bearing section axially surrounds a journal bearing shaft and the disk section fits against a fan housing;
- bolting the bearing housing to the fan housing;
- installing a journal bearing into the cylindrical interior of the bearing section of the bearing housing between the journal bearing shaft and the bearing housing;
- attaching a speed sensor to a portion of the disk section between the small one of the cooling slots and the journal bearing shaft;
- feeding electrical wires from the fan housing through the large cooling slot in the disk section;
- pulling the electrical wires into an inner housing;
- attaching the inner housing to an o-ring seal around the disk section;
- connecting a wire transfer tube to the inner housing;

feeding the electrical wires from the inner housing, through the wire transfer tube, to a terminal box;

connecting the electrical wires to the terminal box; and connecting a motor bearing cooling tube to the inner housing such that a flow of cooling air from the motor bearing cooling tube flows from the inner housing through the cooling slots to provide cooling to a motor stator within the fan housing and through cylindrical interior of the bearing section to provide cooling to the journal bearing.

* * * * *